US006561821B1

(12) United States Patent
Yu

(10) Patent No.: US 6,561,821 B1
(45) Date of Patent: May 13, 2003

(54) HIGH PROFILE BOARD-TO-BOARD ELECTRICAL CONNECTOR ASSEMBLY

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/126,641

(22) Filed: Apr. 19, 2002

(30) Foreign Application Priority Data

Dec. 28, 2001 (TW) ..... 90223566 U

(51) Int. Cl.[7] ..... H01R 12/00

(52) U.S. Cl. ..... 439/74; 439/65; 439/701; 439/591

(58) Field of Search ..... 439/65, 74, 701, 439/591

(56) References Cited

U.S. PATENT DOCUMENTS 5,137,462 A * 8/1992 Casey et al. ..... 439/74
5,647,749 A * 7/1997 Atoh et al. ..... 439/79
5,800,186 A * 9/1998 Ramirez et al. ..... 439/59
6,341,966 B1 * 1/2002 Takada et al. ..... 439/108
6,457,980 B2 * 10/2002 Hattori et al. ..... 439/74

* cited by examiner

*Primary Examiner*—Tho D. Ta
*Assistant Examiner*—Larisa Tsukerman
(74) *Attorney, Agent, or Firm*—Wei Te Chung

(57) ABSTRACT

A board-to-board connector assembly (3, 3') for connecting two printed circuit boards includes a pair of identical board-mountable connectors (1, 1') and an extender (2, 2') interconnecting the pair of connectors. Each connector has an insulating housing (12) defining a mating opening (121) therein and a partition wall (1211) extending in the mating opening, and a number of contacts (11, 11', 13') received in the housing. The extender includes a dielectric base (22) having an H-shaped section, and a plurality of terminals (21, 21') received in the base for electrically engaging with corresponding contacts of the connector.

9 Claims, 5 Drawing Sheets

HIGH PROFILE BOARD-TO-BOARD ELECTRICAL CONNECTOR ASSEMBLY

BACKGROUND OF THE INVENTION

1. Field of the Invention

The present invention relates to a board-to-board connector assembly, and particularly to a board-to-board connector assembly for connecting a daughter board with a mother board which have a requirement of an extended distance therebetween.

2. Description of Prior Art

It is well known that board-to-board connector assembly is used to connect printed circuit boards (PCBs) together, which commonly includes a plug connector mating with a first PCB and a receptacle connector mating with a second PCB. Then, the first and the second PCBs electrically connect with each other by an engagement of the plug and the receptacle connectors. In practical application, a large distance may be required between the two electrically connected PCBs. However, to interconnect the PCBs in such a situation, the connectors should be manufactured with a relative large height, which not only increases the cost but also increases the difficulty in manufacturing the connectors. A conventional board-to-board electrical connector assembly with an increased height is disclosed in U.S. Pat. No. 6,305,982 B1, assigned to the Assignee of the present application.

Hence, an improved board-to-board electrical connector assembly is required to overcome the disadvantages of the prior art.

BRIEF SUMMARY OF THE INVENTION

An object of the present invention is to provide a board-to-board electrical connector assembly having an increased height to thereby interconnect printed circuit boards with a large distance therebetween. The assembly is formed by an effective and economical way.

In order to achieve the above-mentioned object, a board-to-board connector assembly in accordance with the present invention includes a pair of identical board-mountable connectors and an H-shaped extender interconnected between the board-mountable connectors. The board-mountable connector comprises an insulating housing defining a mating opening for engaging with the extender, in which a partition wall is extending, and a plurality of female contacts received in the insulating housing. Each female contact of the board-mountable connector includes a resilient contact portion configured in a "V" shaped. The H-shaped extender has a dielectric base defining a pair of engaging cavities separated by a central wall, and a plurality of terminals attached to opposite longitudinal inner faces of the dielectric base for electrically engaging with corresponding contacts of the connectors. In assembly, an upper end and a lower end the extender are respectively received in the mating openings of the board-mountable connectors, and the partition walls of the board-mountable connectors are engaged within the engaging cavities of the extender. The height of the extender can be adjusted according to the assembling requirement, and the structure of the extender is designed so simply that reduces the manufacturing cost and improves the productive efficiency.

Other objects, advantages and novel features of the invention will become more apparent from the following detailed description of the present embodiment when taken in conjunction with the accompanying drawings.

DETAILED DESCRIPTION OF THE INVENTION

Figure 1:
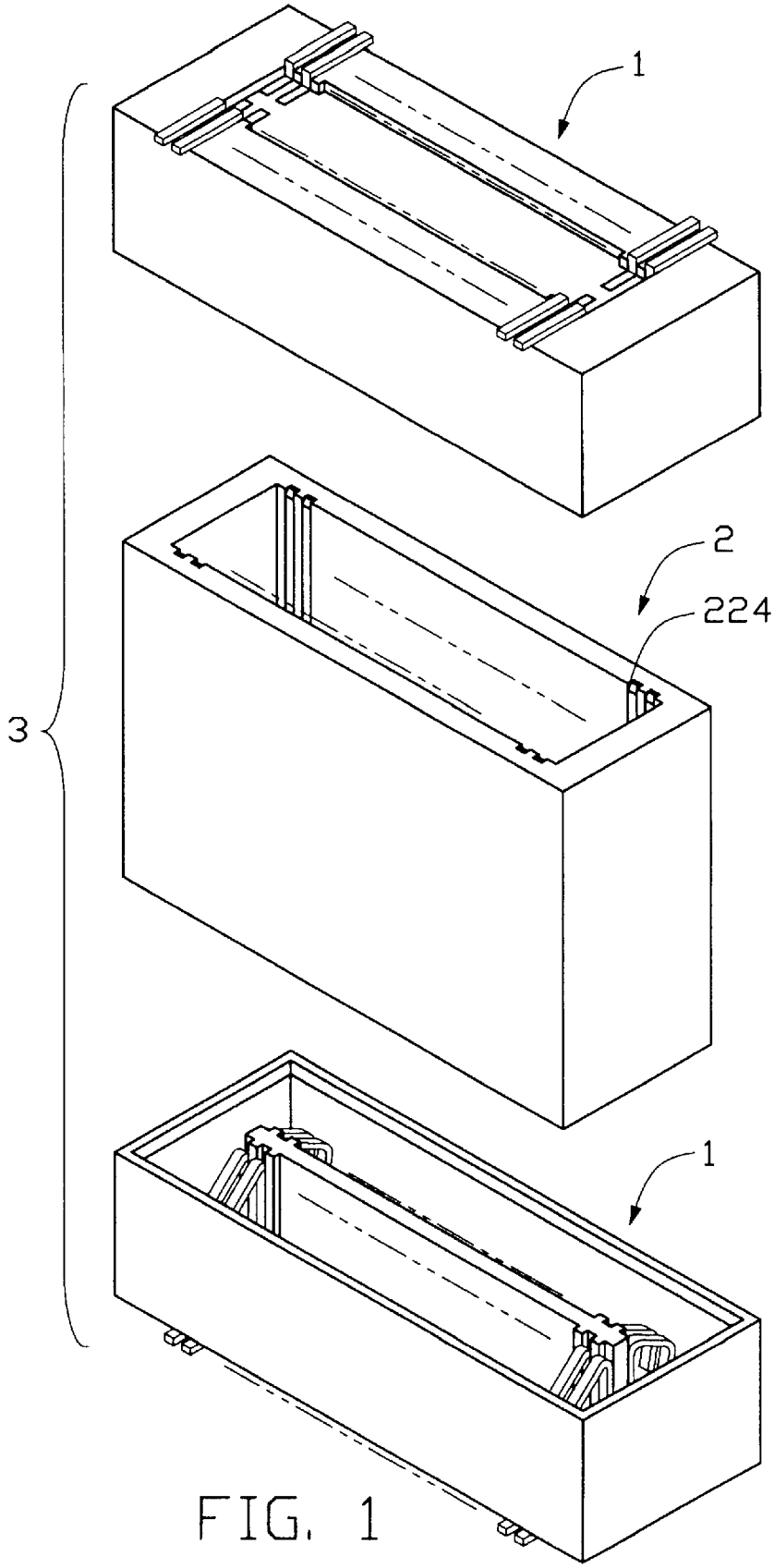
FIG. 1 is an exploded, perspective view of a board-to-board connector assembly in accordance with a first embodiment of the present invention.

Reference will now be made to the drawing figures to describe the present invention in detail.

Figure 2:
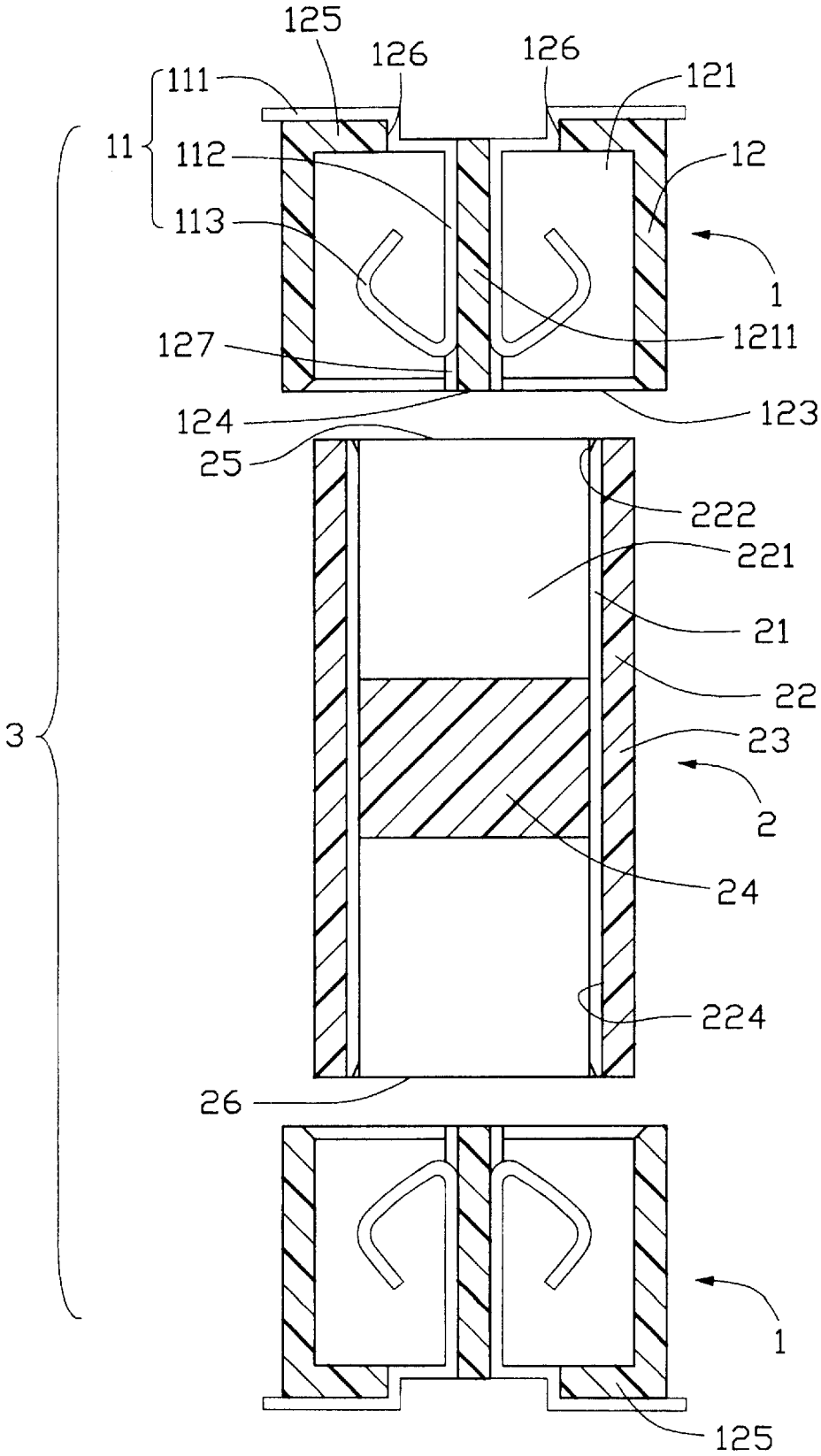
FIG. 2 is a cross-sectional view of the board-to-board connector assembly of FIG. 1.
Figure 3:
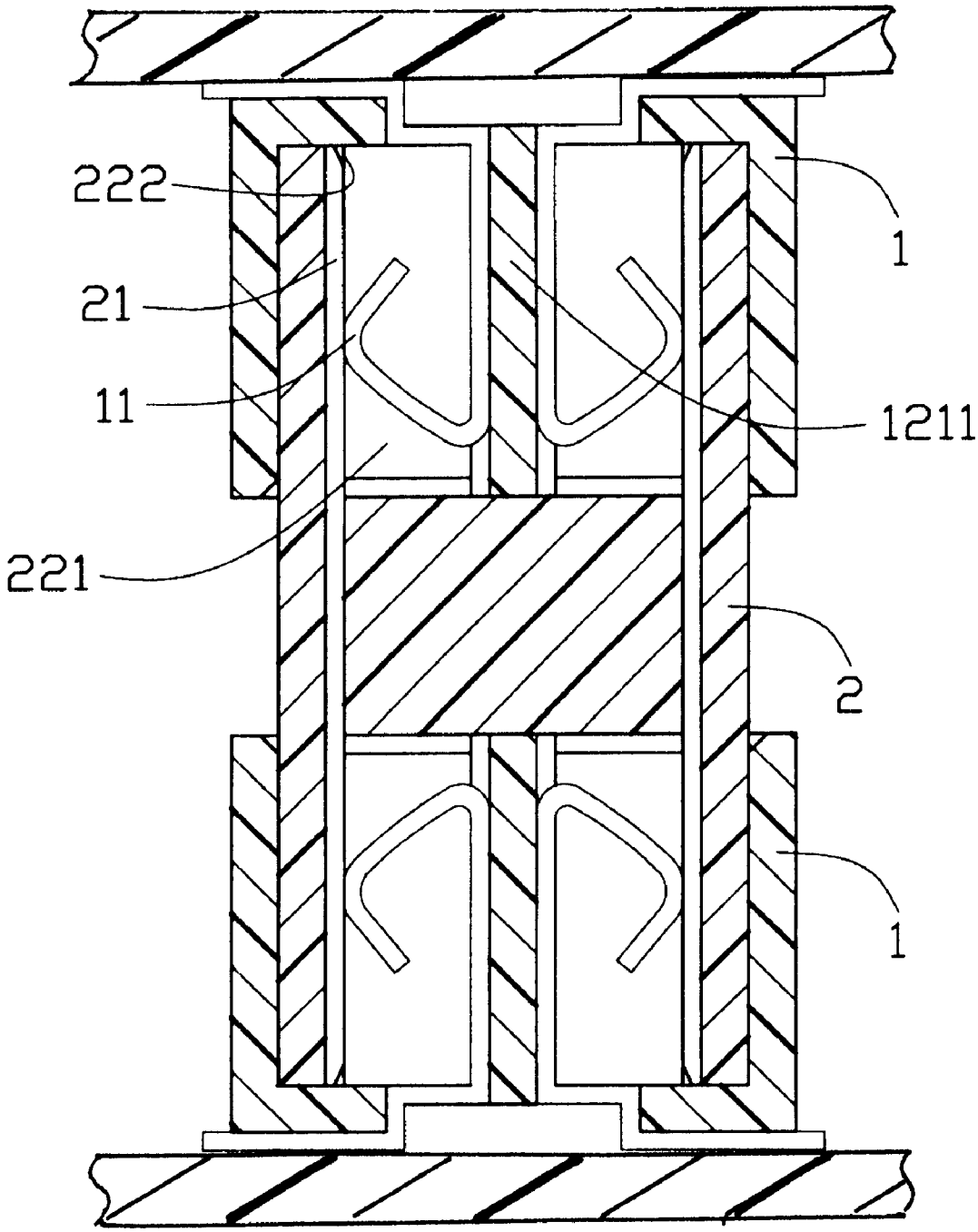
FIG. 3 is an assembled view of FIG. 2.

Referring to FIGS. 1–3, a board-to-board connector assembly 3 in accordance with a first embodiment of the present invention comprises a pair of identical board-mountable connectors 1 respectively mountable onto a pair of separated PCBs (not shown) and an extender 2 located between and engaging with the pair of board-mountable connectors 1.

The board-mountable connector 1 includes an elongated insulating housing 12 with a mating opening 121 defined therein, and a plurality of female contacts 11 received in the insulating housing 12. A mating face 124 is formed on a topside of the insulating housing 12 for coupling with the extender 2. A partition wall 1211 projects straightly from a middle of a bottom wall 125 toward the mating face 124. A pair of entrances 123 and a pair of through holes 126 are respectively formed in the mating face 124 and the bottom wall 125, and communicate with the mating opening 121. Each contact 11 comprises an intermediate portion 112 received in a corresponding passageway 127 defined in each of two opposite sides of the partition wall 1211 and abutting thereagainst, a solder portion 111 extending out of the bottom wall 125 through the through hole 126 for soldering to a corresponding PCB, and a resilient contact portion 113 extending from an end of the intermediate portion 112 opposite the solder portion 111. The resilient contact portion 113 is received in the mating opening 121 and configured in an approximate "V" shape pointing in a direction away from the partition wall 1211.

The extender 2, which has an H-shaped section, includes a dielectric base 22 and a plurality of terminals 21 received in the dielectric base 22. The dielectric base 22 has upper and lower engaging cavities 221 exposed to upper and lower ends 25, 26 thereof, respectively. The cavities 221 are surrounded by four sidewalls 23 of the dielectric base 22 and separated from each other via a horizontally extending central wall 24. The extender 2 defines a plurality of channels 224 in opposite inner faces 222 of two longitudinal sidewalls 23 for receiving corresponding terminals 21 therein. Each terminal 21 is a male terminal and has a linear configuration. The channels 224 are communicating with the engaging cavities 221.

As shown in FIG. 3, the two board-mountable connectors 1 are assembled on the extender 2 with the upper end 25 and the lower end 26 of the extender 2 being respectively received in the mating openings 121 of the two board-mountable connectors 1, and the partition walls 1211 of the board-mountable connectors 1 being retained in the engaging cavities 221 of the extender 2. The mating face 124 of each board-mountable connector 1 engages with a corresponding side of the central wall 24 of the extender 2, and the resilient contact portion 113 of each contact 11 electrically connects with a corresponding conductive terminal 21 of the extender 2.

Figure 4:
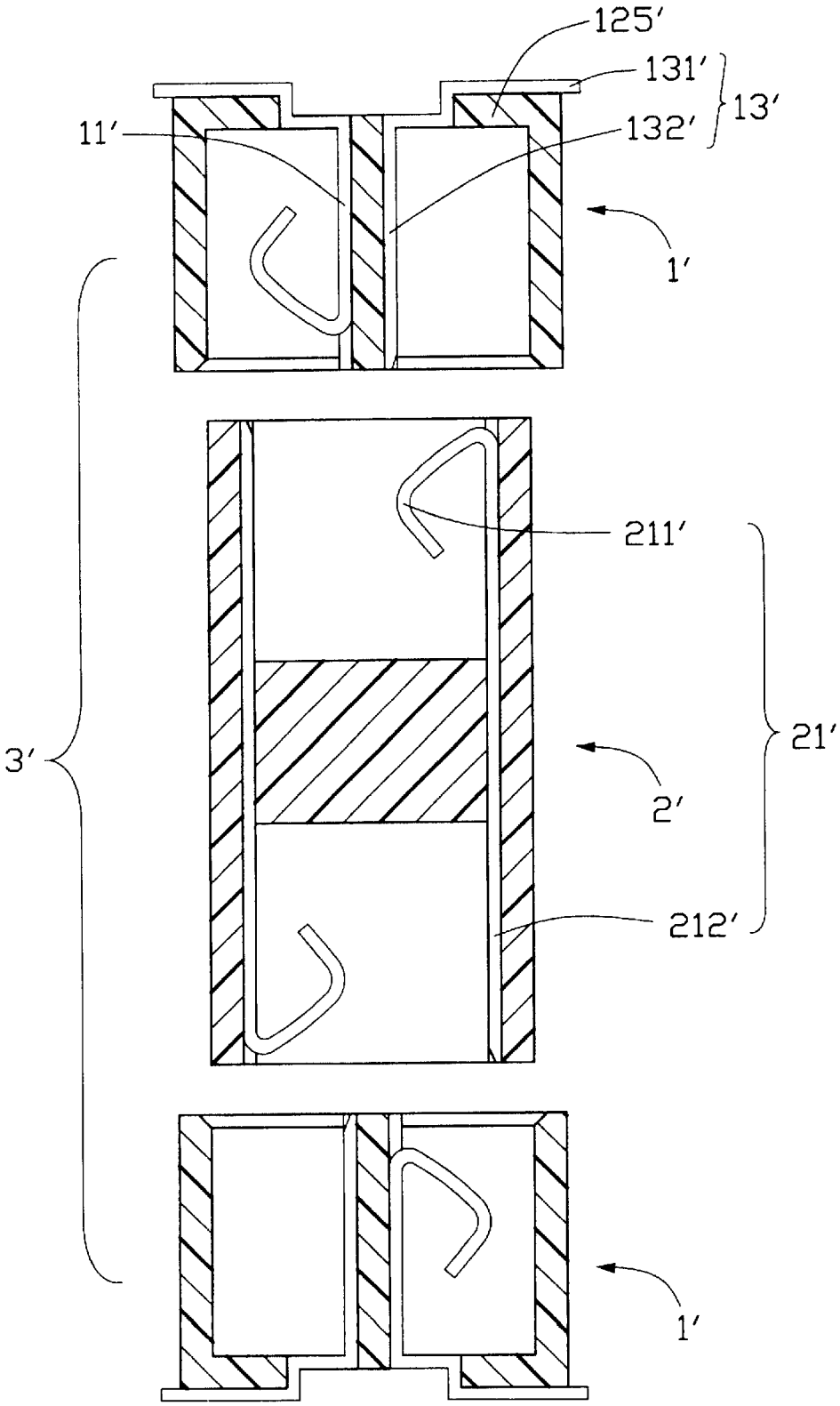
FIG. 4 is an exploded, cross-sectional view of a board-to-board connector assembly in accordance with a second embodiment of the present invention.
Figure 5:
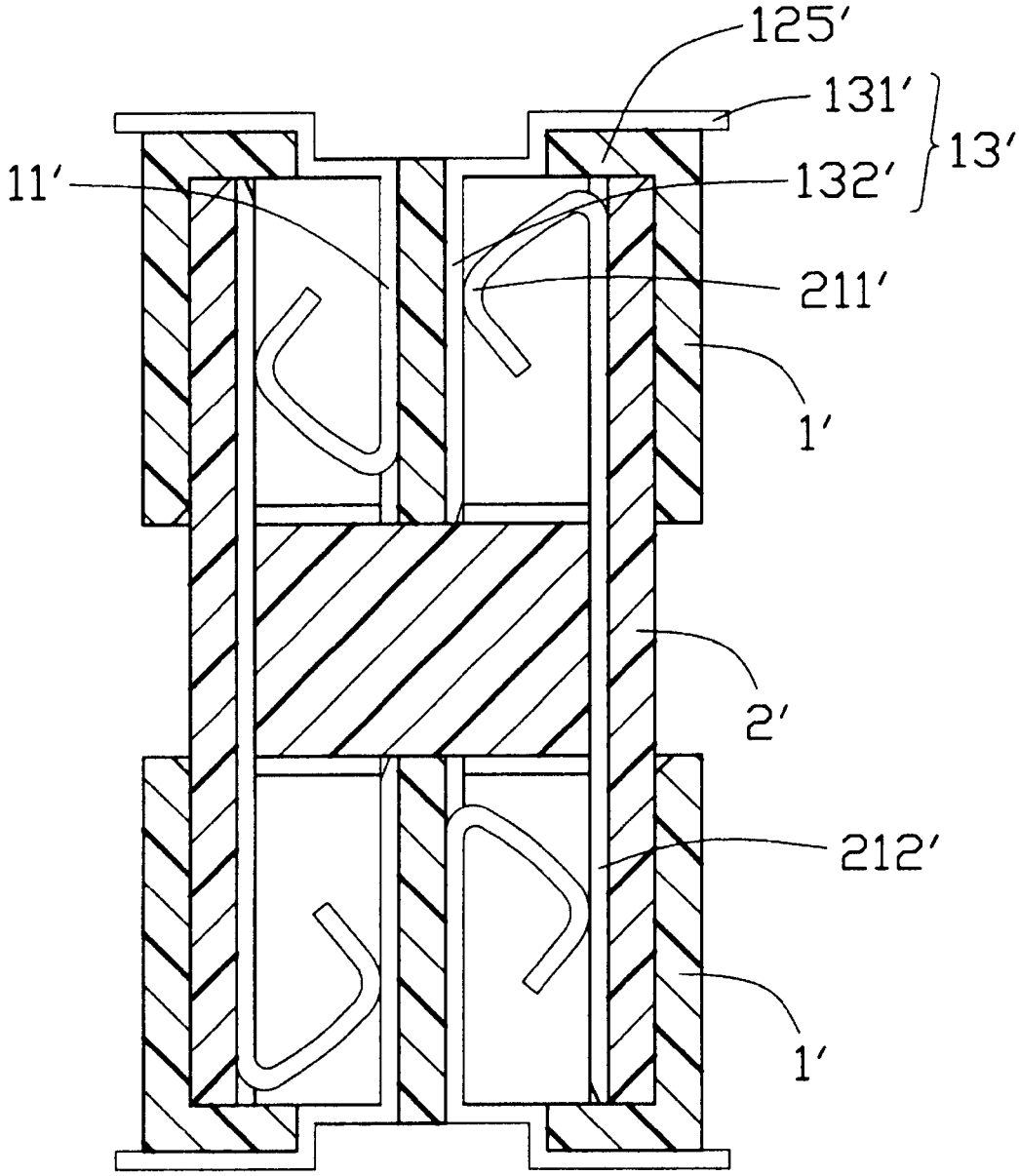
FIG. 5 is an assembled view of FIG. 4.

FIG. 4 illustrates a second embodiment of the present invention. The difference between the second embodiment and the first embodiment is that the board-mountable connectors 1' and the extender 2' of the second embodiment are respectively structured as a hermaphrodite. That is, each board-mountable connector 1' has a row of male contacts 13' and simultaneously a row of female contacts 11' received therein. Each female contact 11' has a same structure as the contact 11 of the first embodiment, while each male contact 13' comprises a solder portion 131' extending out of a bottom wall 125' and a substantially straight contact portion 132'. Correspondingly, the extender 2' has each terminal 21' thereof configured as a male terminal at one end thereof which has a straight contact portion 212' to engage with a corresponding female contact 11' of one of the board-mountable connectors 1', and a female terminal at the other end thereof which has a V-shaped contact portion 211' to engage with a corresponding male contact 13' of the other of the board-mountable connectors 1'.

The identical board-mountable connectors 1, 1' and the H-shaped extender 2, 2' simplify the manufacturing process and reduce the cost. In application, when it needs to increase or reduce the distance between the two electrically connected PCBs, an extender having a similar configuration as the extender 2(2') with a different height can be used to interconnect the board-mountable connectors 1(1').

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the term which the appended claims are expressed.

What is claimed is:

1. An electrical connector assembly adapted for interconnecting two separated printed circuit boards, comprising:

a pair of board-mountable connectors adapted for mounting onto the respective printed circuit boards, each board-mountable connector having an insulating housing defining a mating opening therein, a partition wall separating said mating openings, and a plurality of contacts attaching to opposite sides of said partition wall; and an extender located between the board-mountable connectors and having a dielectric base and a plurality of terminals, the extender defining a pair of engaging cavities exposed to an upper end and a lower end thereof and a plurality of channels communicating with said engaging cavities, the terminals being received in corresponding channels of said dielectric base;

wherein the upper end and the lower end of said extender are respectively engaged within said mating openings of the board-mountable connectors, and wherein the partition wall of each board-mountable connector is received in a corresponding engaging cavity of said extender with the contacts of said board-mountable connectors electrically engaging with the terminals of said extender.

2. The electrical connector assembly as described in claim 1, wherein said extender has four vertically extending sidewalls and a horizontally extending central wall, and wherein the plurality of channels are defined in opposite longitudinal sidewalls, and the engaging cavities are separated from each other by the horizontally extending central wall.

3. The electrical connector assembly as described in claim 2, wherein each said board-mountable connector defines a plurality of passageways in opposite sides of the partition wall, and wherein each contact of said board-mountable connector comprises a solder portion extending out of a bottom of the insulating housing, a generally V-shaped resilient contact portion for electrically connecting with a corresponding terminal of said extender, and an intermediate portion fixedly received in the passageway.

4. The electrical connector assembly as described in claim 2, wherein each of said board-mountable connectors defines a plurality of passageways in opposite sides of the partition wall, and have a row of first contacts and a row of second contacts respectively received in the passageways in the opposite sides of the partition wall.

5. The electrical connector assembly as described in claim 4, wherein each of said first contacts comprises a solder portion extending out of a bottom of the insulating housing, a generally V-shaped resilient contact portion for electrically connecting with a corresponding terminal of said extender, and an intermediate portion fixedly received in a corresponding passageway.

6. The electrical connector assembly as described in claim 4, wherein each of said second contacts comprises a solder portion extending out of a bottom of the insulating housing and a straight contact portion received in a corresponding passageway for electrically connecting with a corresponding terminal of said extender.

7. The electrical connector assembly as described in claim 4, wherein each said terminal of said extender has a substantial straight contact portion at one end thereof, and a generally V-shaped contact portion at the other end thereof.

8. A board-to-board connector assembly, comprising:

a pair of board-mountable connectors each having an insulative housing defining a mating opening, and a plurality of contacts received in the mating opening and adapted for engaging with a printed circuit board; and an extender interconnected between the connectors, the extender having a first end extending into the mating opening of one of the connectors and an opposite second end extending into the mating opening of the other of the connectors, and a plurality of terminals electrically engaging with the contacts of the connector, wherein each insulative housing has a partition wall in the mating opening and the contacts are fixed to two opposite sides of the partition wall, each contact having a V-shaped contacting portion engaging with a corresponding terminal, the V-shaped contact portion pointing in a direction away from the partition wall.

9. A board-to-board connector assembly comprising:

a pair of printed circuit boards spaced from each other in a parallel relation with a predetermined vertical distance therebetween;

a pair of identical board-mount connectors respectively mounted on the printed circuit boards in an opposite manner, each of said connectors including an insulative housing with a two rows of contacts therein;

an extender positioned between said pair of connectors and mechanically and electrically connected thereto at two opposite ends thereof;

said extender including an unitary insulating housing with two cavities at said opposite ends, respectively;

two rows of terminals extending along inner surfaces of two sides walls of the insulating housing through said housing in a vertical direction, each of said terminals in each row defining two opposite ends extending into the corresponding cavities, respectively; wherein at least one of said two ends of said each of the terminals keeps straight without bending so as to allow said each of the terminals to be able to be inserted into the insulating housing in the vertical direction.

* * * * *